US007021717B2

(12) United States Patent
Gaylord et al.

(10) Patent No.: US 7,021,717 B2
(45) Date of Patent: Apr. 4, 2006

(54) LOUNGE CHAIR WITH MOVABLE ARMS

(76) Inventors: Robert A. Gaylord, 1628 Duke of Windsor, Virginia Beach, VA (US) 23454; Oliver Wang, 1013 Chinachen Golden Plaza, 77 Mody Road TST East, Kowloon (HK)

( * ) Notice: Subject to any disclaimer, the term of this patent is extended or adjusted under 35 U.S.C. 154(b) by 0 days.

(21) Appl. No.: 10/722,922

(22) Filed: Nov. 26, 2003

(65) Prior Publication Data

US 2005/0110325 A1 May 26, 2005

(51) Int. Cl.
*A47C 7/54* (2006.01)

(52) U.S. Cl. ..... 297/411.33; 297/115

(58) Field of Classification Search ..... 297/115, 297/411.33, 411.35, 411.36
See application file for complete search history.

(56) References Cited

U.S. PATENT DOCUMENTS

| | | | | | |
|---|---|---|---|---|---|
| 1,185,181 | A | | 5/1916 | Collins | |
| 1,399,744 | A | * | 12/1921 | Brophy | 297/411.33 |
| 2,024,170 | A | * | 12/1935 | Kruse | 297/411.36 |
| 2,614,612 | A | | 10/1952 | Wogomon | |
| 3,679,257 | A | * | 7/1972 | Jacuzzi et al. | 297/411.33 |
| 3,737,926 | A | | 6/1973 | Hermanson | |
| 4,252,371 | A | * | 2/1981 | Lehnen | 297/411.44 |
| 4,441,756 | A | | 4/1984 | Liou | |
| 4,955,517 | A | * | 9/1990 | Maresca | 297/411.36 |
| 5,062,676 | A | * | 11/1991 | Mars | 297/411.36 |
| 5,547,245 | A | * | 8/1996 | Knouse | 297/411.33 |
| 5,944,384 | A | * | 8/1999 | Patterson | 297/344.23 |
| 6,082,820 | A | | 7/2000 | Jeng | |
| 6,109,685 | A | | 8/2000 | Lindsey | |
| 6,213,555 | B1 | | 4/2001 | Sulpizio | |
| 6,293,624 | B1 | | 9/2001 | Gaylord | |
| 6,585,323 | B1 | | 7/2003 | Gaylord | |
| 6,761,397 | B1 | * | 7/2004 | Tseng | 297/115 |

* cited by examiner

*Primary Examiner*—Peter R. Brown
(74) *Attorney, Agent, or Firm*—Williams Mullen; M. Bruce Harper; Kimberly Chasteen

(57) ABSTRACT

A lounge chair having movable armrests. The lounge chair comprises a seat, a back, legs and armrests. The armrests may be placed in a raised position for use by the occupant or may be swing down to provide more room or to allow the occupant to easily exit the lounge chair. The armrests are preferably attached to each other such that moving one arm to the lowered position simultaneously moved the other arm to the lowered position.

5 Claims, 4 Drawing Sheets

LOUNGE CHAIR WITH MOVABLE ARMS

FIELD OF THE INVENTION

The disclosed invention relates to lounge chairs. In particular, the present invention relates to lounge chairs which have simultaneously movable arms.

DESCRIPTION OF RELATED ART

Lounge chairs, in many different forms have been used for quite some time. Lounge chairs without arms are shown in U.S. Pat. Nos. 6,585,323, 6,293,624, 6,213,555, 6,109,685 and 3,737,926. These chairs generally have a flat portion for the user's legs and a fixed or adjustable portion for the user's back and head. The chairs have fixed or foldable legs and may include wheels for ease of relocation of the chair. The chairs are covered with slats of wood, plastic, vinyl or fabric or by a solid piece of these materials. Other lounge chairs include arms such as those shown in U.S. Pat. Nos. 6,082,820, 4,441,756, 4,252,371, 2,614,612 and 1,185,181. These chairs are similar to those without arms discussed previously but also include arms. In some examples, the arms are rigid; in others, the arms fold as the chair is collapsed for transport or storage.

These prior art lounge chairs lack an arm structure which may be moved by an occupant of the chair. Such a structure is desirable to facilitate exiting the chair. Moving the arms also allows different occupants to configure the chair to their personal tastes, whether they prefer a lounge chair with arms or without. None of the above inventions and patents, taken either singly or in combination, is seen to describe the present invention as claimed.

Accordingly, it is an object of the present invention to provide a lounge chair which includes arms which are movable.

It is another object of the present invention to provide a lounge chair with movable arms to facilitate entering or exiting the chair.

It is another object of the present invention to provide a lounge chair with movable arms which may be moved simultaneously with a single motion.

It is yet a further object of the present invention to provide a lounge chair which is convenient and easy to use.

Finally, it is an object of the present invention to accomplish the foregoing objectives in a simple and cost effective manner.

SUMMARY OF THE INVENTION

A lounge chair having movable arms includes a seat, adjustable back, legs and at least one armrest which may be raised or lowered as needed or desired, independently of the orientation of the back. The seat is preferably horizontally oriented, adjustable and made in the configuration of a frame covered in part by material with the material disposed within the frame. The back is preferably adjustable between a vertical orientation and a horizontal orientation and is made in a frame and material configuration similar to the seat. The armrest or armrests preferably have an upper horizontal member; and at least one vertical support member which may be connected to the seat. If both armrests are collapsible, a horizontal member may connect the armrests to facilitate collapsing or raising the armrests. In the preferred embodiment, a stop element is provided to limit motion of the armrest or armrests beyond a desired orientation in either or both directions.

ELEMENT LIST

Figure 1:
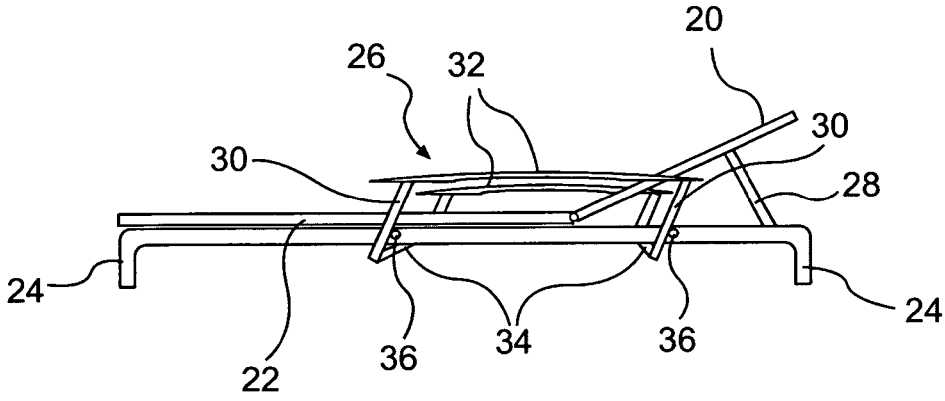
FIG. 1 shows the preferred embodiment of the present invention with the armrests raised.

20 back
22 seat
24 legs
26 armrests
28 support beam
30 vertical element
32 horizontal element
34 horizontal bar
36 stops
38 bolt
40 bolt

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

The present invention provides a lounge chair which has movable armrests for ease of use. The chair includes a seat, back, armrests and legs. The armrests can be moved between a position which is elevated above the seat portion and a position which is preferably substantially even with the seat portion. This motion is achieved independently of the orientation of the seat portion or the back portion. This allows a user of the lounge chair to determine whether they wish to use the armrests or not and provides a convenient orientation for the armrests when they are not desired. Further, by lowering the armrests, egress from the chair is facilitated. Preferably, both armrests may be lowered by a single motion.

Figure 2:
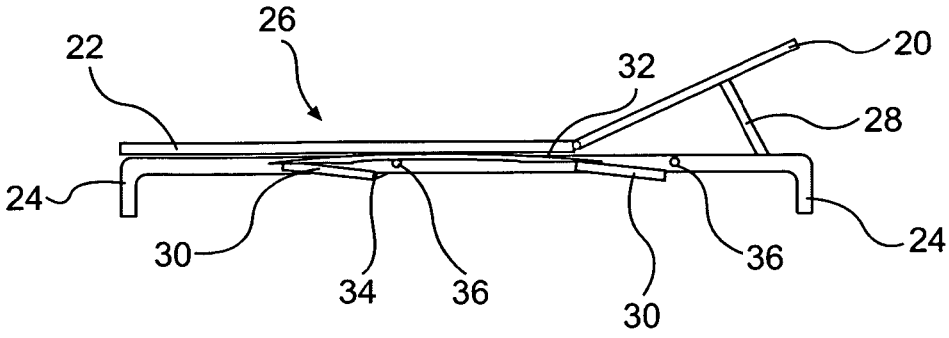
FIG. 2 shows the preferred embodiment of the present invention with the armrests lowered.

The lounge chair, shown in FIGS. 1 and 2, includes a back 20, a seat 22, legs 24 and armrests 26. The back 20 is preferably adjustable between at least a generally vertical position and a generally horizontal position. The adjustment may be made by any means known in the art such as a support beam 28 as shown. The back 20 may also have a fixed position, either in an upright, vertical position or in a horizontal position. The seat 22 preferably includes a horizontal element and may be entirely horizontal. Alternatively, the seat 22 may include a vertical portion for supporting the user's legs. If desired, the seat 22 may be adjustable to allow for different orientations of the user's legs and/or feet.

The seat 22 and back 20 are formed by any means known in the art for lounge chairs. Generally, the seat 22 and back 20 are constructed from heavy-duty, weather resistant materials. The construction may include a tubular frame with nylon, fabric or plastic straps stretched across the frame. Alternatively, sheets of material may be attached to the frame to provide support for the user. A wooden frame with rigid slats disposed within the frame may also be used.

The seat 22 and back 20 are preferably supported by legs 24. The legs may be constructed from the same material as the seat 22 and back 20 frames or may be different. The legs 24 may include wheels (see FIGS. 3 and 4) to facilitate moving the lounge chair or may fold for ease of storage.

Figure 3:
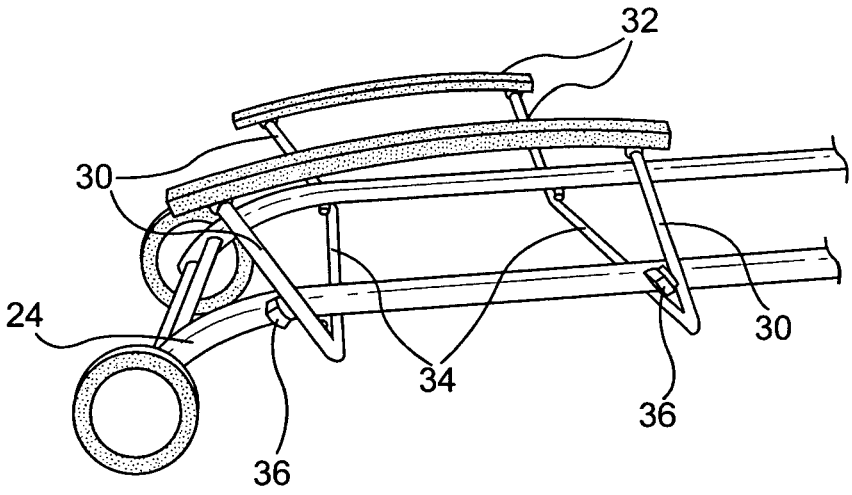
FIG. 3 is an exploded view of the preferred armrest assembly with the armrests raised.
Figure 4:
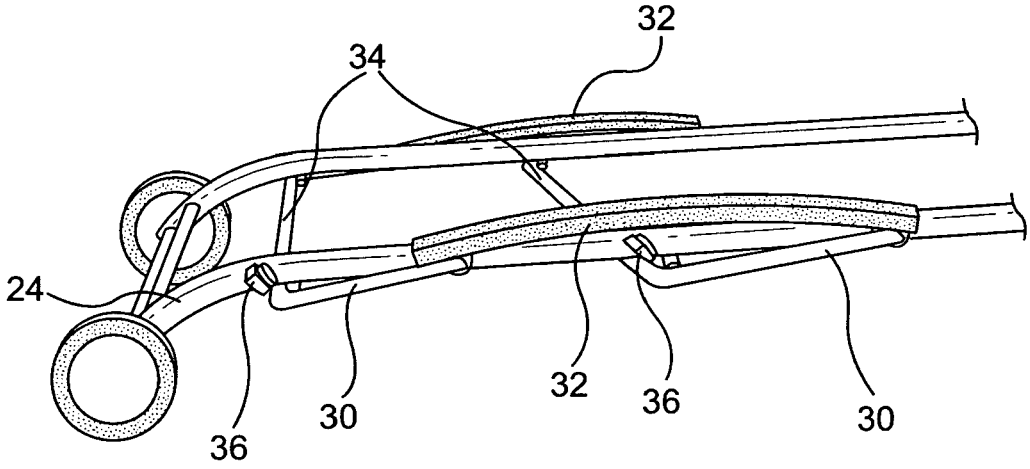
FIG. 4 is an exploded view of the preferred armrest assembly with the armrests lowered.
Figure 5:
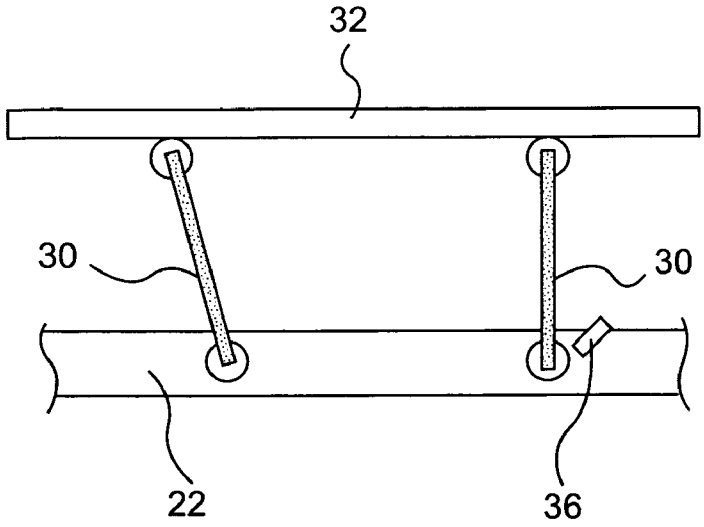
FIG. 5 is a detailed view of the armrest assembly of the preferred embodiment of the present invention.

The armrests 26 consist of vertical elements 30 which support a horizontal element 32 as shown in more detail in FIGS. 3 and 4. The upper ends of the vertical elements 32 are preferably pivotally connected (see detail of preferred pivot construction in FIG. 7) to the horizontal element 32 to allow rotational movement between the horizontal 32 and vertical 30 elements. The lower ends of the vertical elements are preferably connected to horizontal bar 34 and pivotally connected (see detail of the preferred pivot construction in FIG. 6) to the seat 22. The horizontal bar 34 connects the lower ends of vertical elements 32 on opposite sides of the seat 22. Thus, when one armrest 26 is moved, the other armrest is also moved. In the preferred embodiment, horizontal bars 34 connect both pairs of vertical elements 32 as shown in FIGS. 1–4. The armrests 26 are preferably constructed from a heavy-duty weather resistant material like the frame and may be from the same material or a different material.

To control the movement of the armrests 26, one or more stops 36 may be used. In FIGS. 1–4, two stops 36 are used on each side of the lounge chair. As shown in FIGS. 1 and 3, when the armrest 26 is in the upright position, the vertical elements 30 rest against the stops 36. The stops 36 maintain the armrests 26 in an upright position for use by the lounge chair's occupant. FIGS. 2 and 4 show the armrests 26 in the lowered position. To achieve this configuration, the armrests 26 are moved forward, away from the stops 36. Preferably, the armrests are connected by the horizontal bar 34 such that one single motion moves both armrests into the desired configuration. Preferably, the horizontal element 32 of the armrests is held in the desired lowered position by at least one of the stops 36 as is shown in FIG. 2. A configuration using a horizontal bar 34 to connect the armrests 26 may require only one stop 36 to control the movement of the entire armrest 26. The stops 36 are preferably connected to the seat 22 and are preferably constructed from a shock absorbing material such as rubber or a plastic.

Figure 6:
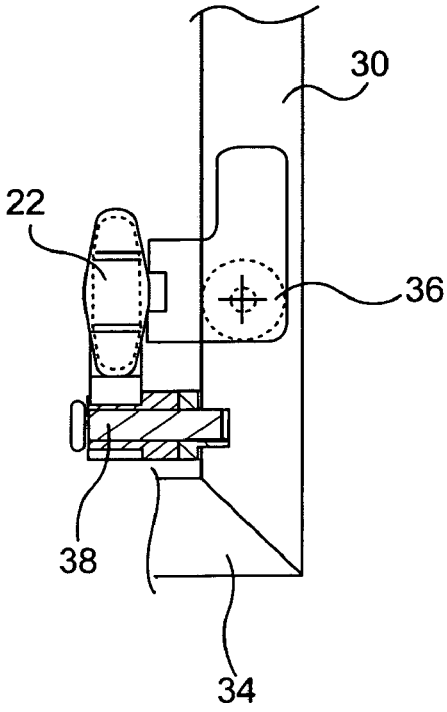
FIG. 6 is a detailed view of the armrest of the preferred embodiment of the present invention.
Figure 7:
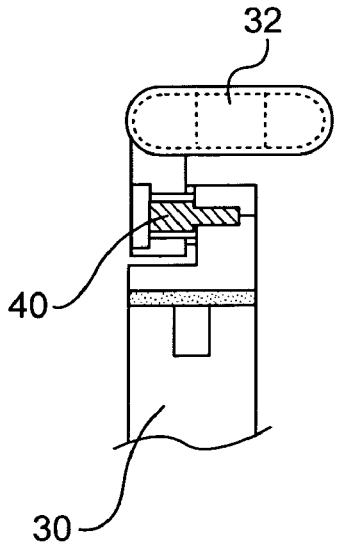
FIG. 7 is a further detailed view of the armrest of the preferred embodiment of the present invention.
Figure 8:
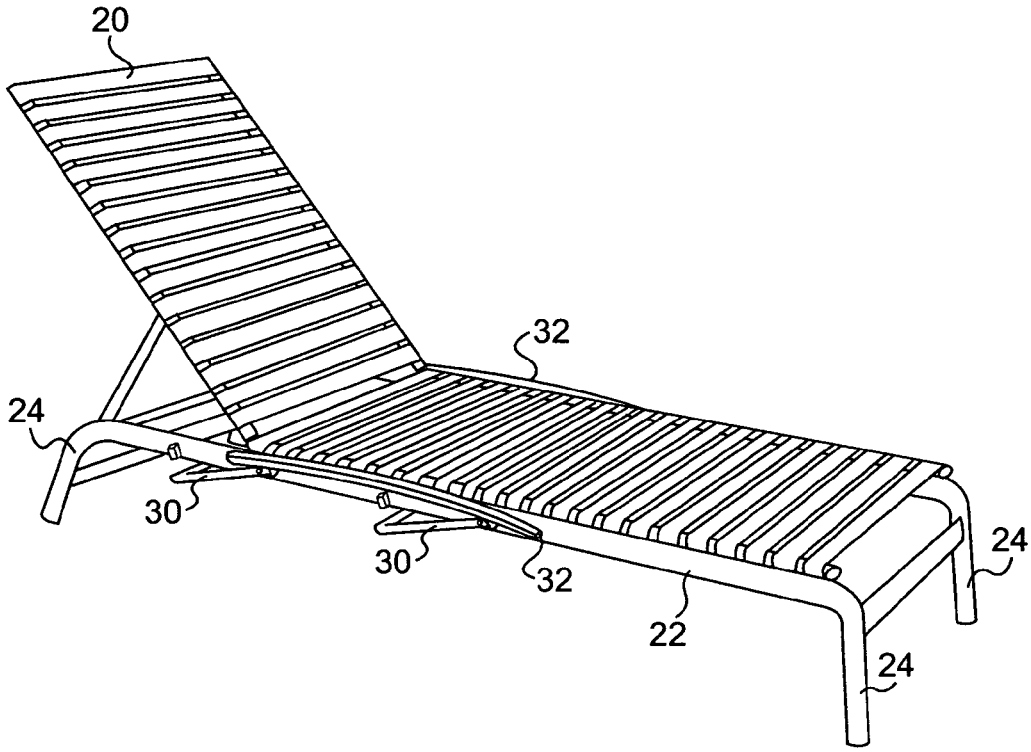
FIG. 8 is a perspective view of the present invention.

As discussed previously, the vertical elements 30 of the armrests 26 are preferably pivotally connected to the horizontal element 32 and the seat 22. The preferred constructions for these connections are shown in detail in FIGS. 6 and 7. FIG. 6 shows the connection between the lower end of the vertical element 30 and the seat 22. In this preferred embodiment, the vertical element 30 is bolted to the seat 22 in a manner that allows rotation about the bolt 38. Similarly, as shown in FIG. 7, the upper end of the vertical element 30 is bolted 40 to the horizontal element 32 in a manner which allows rotation about the bolt 40.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A lounge chair, comprising:

a seat portion comprising a tubular seat frame and a covering material of at least one strap, which at least partially covers the seat frame;

a back portion adjacent to the seat portion and capable of being placed in a vertical orientation, wherein the back portion comprises a tubular back frame and a covering material of at least one strap, which at least partially covers the back frame;

a plurality of legs which support the seat and back portions, wherein said plurality of legs are extensions of said tubular seat frame; and at least one armrest which is pivotally mounted to the seat frame and movable between a first position above the seat portion and a second position which is lower in height than the first position, wherein the orientation of the at least one armrest is independent of the orientation of the back portion, and wherein at least one stop is positioned on the tubular seat frame and configured so as to support the at least one armrest when resting in the first position and to prevent movement of the at least one armrest beyond the first position.

2. The lounge chair as set forth in claim 1 wherein the seat portion is substantially horizontally oriented.

3. The lounge chair as set forth in claim 1 wherein each at least one armrest comprises:

an upper substantially horizontal member; and at least one substantially vertical support member pivotally mounted to the tubular seat frame.

4. The lounge chair as set forth in claim 3 wherein each at least one vertical support member is pivotally mounted to the tubular seat.

5. The lounge chair as set forth in claim 3 comprising two armrests and further comprising at least one horizontal member which connects the two armrests.

* * * * *